US007079363B2

(12) United States Patent
Chung

(10) Patent No.: US 7,079,363 B2
(45) Date of Patent: Jul. 18, 2006

(54) HYBRID DC ELECTROMAGNETIC CONTACTOR

(75) Inventor: Yong-Ho Chung, Ansan (KR)

(73) Assignee: LG Industrial Systems Co., Ltd., Seoul (KR)

( * ) Notice: Subject to any disclaimer, the term of this patent is extended or adjusted under 35 U.S.C. 154(b) by 305 days.

(21) Appl. No.: 10/404,061

(22) Filed: Apr. 2, 2003

(65) Prior Publication Data

US 2003/0193770 A1 Oct. 16, 2003

(30) Foreign Application Priority Data

Apr. 12, 2002 (KR) ..... 10-2002-0020112

(51) Int. Cl.
*H01H 73/18* (2006.01)

(52) U.S. Cl. ..... 361/13

(58) Field of Classification Search ..... 361/13, 361/2, 6, 7, 8

See application file for complete search history.

(56) References Cited

U.S. PATENT DOCUMENTS 4,356,525 A * 10/1982 Kornrumpf et al. ..... 361/4
4,420,784 A * 12/1983 Chen et al. ..... 361/7
4,438,472 A 3/1984 Woodworth ..... 361/13
4,658,320 A 4/1987 Hongel ..... 361/13
4,700,256 A * 10/1987 Howell ..... 361/13
4,704,652 A * 11/1987 Billings ..... 361/5
4,745,511 A * 5/1988 Kugelman et al. ..... 361/8
4,760,483 A * 7/1988 Kugelman et al. ..... 361/13
4,959,746 A * 9/1990 Hongel ..... 361/13
5,151,840 A * 9/1992 Siefken ..... 361/13
5,162,682 A 11/1992 Lu ..... 307/631
5,164,872 A * 11/1992 Howell ..... 361/3
5,252,907 A * 10/1993 Harris et al. ..... 323/285
5,283,706 A * 2/1994 Lillemo et al. ..... 361/3
5,463,252 A * 10/1995 Jones et al. ..... 257/723
5,530,615 A * 6/1996 Miller et al. ..... 361/160
5,536,980 A * 7/1996 Kawate et al. ..... 307/116
5,578,980 A * 11/1996 Okubo et al. ..... 335/132
5,652,688 A * 7/1997 Lee ..... 361/13

(Continued)

FOREIGN PATENT DOCUMENTS

JP 61-95611 5/1986

(Continued)

OTHER PUBLICATIONS

Translation of the Official Action of the German Patent and Trademark office dated Apr. 26, 2005.*

(Continued)

*Primary Examiner*—Stephen W. Jackson
*Assistant Examiner*—James A. Demakis
(74) *Attorney, Agent, or Firm*—Greenblum & Bernstein, P.L.C.

(57) ABSTRACT

In a hybrid DC electromagnetic contactor, by including a power unit for supplying a certain power voltage; a main contact point of a breaking switch for providing a supply path of the power voltage by being switched in accordance with a voltage apply to an operational coil; a switch for providing a supply path of the power voltage according to a gate signal; a snubber circuit for charging voltage at the both ends of the switch in turning off of the switch and being applied-discharged an electric current when the charged voltage is not less than a certain voltage; and a discharge current removing unit for removing the discharge current by providing a discharge current path to a load block in turning off of the switch, it is possible to minimize a size of leakage current when the main contact point and the semiconductor switch are turned off, and accordingly it can be practically used.

17 Claims, 7 Drawing Sheets

U.S. PATENT DOCUMENTS

| | | | | |
|---|---|---|---|---|
| 5,699,218 | A * | 12/1997 | Kadah | 361/13 |
| 5,703,743 | A | 12/1997 | Lee | 361/6 |
| 5,790,354 | A * | 8/1998 | Altiti et al. | 361/8 |
| 5,923,513 | A * | 7/1999 | Pelly | 361/90 |
| 6,046,899 | A * | 4/2000 | Dougherty | 361/173 |
| 6,891,705 | B1 * | 5/2005 | Bryan | 361/2 |

FOREIGN PATENT DOCUMENTS

| | | |
|---|---|---|
| JP | 61-095611 | 5/1986 |
| JP | 3-107328 | 5/1991 |
| JP | 6-3872 | 1/1994 |
| JP | 6-113525 | 4/1994 |
| JP | 6-113534 | 4/1994 |
| JP | 6-169564 | 7/1994 |
| JP | 6-88192 | 12/1994 |
| JP | 8-725 | 1/1996 |
| JP | 8-055721 | 2/1996 |
| JP | 8-55721 | 2/1996 |
| JP | 8-088552 | 4/1996 |
| JP | 8-88552 | 4/1996 |
| JP | 8-195664 | 7/1996 |
| JP | 2560659 | 9/1996 |
| JP | 8-331859 | 12/1996 |
| JP | 11-178321 | 7/1999 |
| JP | 11-265644 | 9/1999 |
| JP | 00-36238 | 2/2000 |
| JP | 2000-036238 | 2/2000 |
| JP | 2000-188043 | 7/2000 |
| JP | 2002-95253 | 3/2002 |
| JP | 2002-095253 | 3/2002 |

OTHER PUBLICATIONS

English Language Abstract of JP 2000-36238.
English Language Abstract of JP 8-195664.
English Language Abstract of JP 2002-95253.
English Language Abstract of JP 61-95611.
English Language Abstract of JP 8-55721.
English Language Abstract of JP 8-88552.
English Language Abstract of JP 8-725.
English Language Abstract of JP 6-169564.
English Language Abstract of JP 11-265644.
English Language Abstract of JP-113534.
English Language Abstract of JP 8-331859.
English Language Abstract of JP 11-178321.
English Language Abstract of JP 2000-188043.
English Language Abstract of JP 2000-036238.
English Language Abstract of JP 8-195664.
English Language Abstract of JP 2002-095253.
English Language Abstract of JP 61-095611.
English Language Abstract of JP 8-055721.
English Language Abstract of JP 8-088552.
English Language Abstract of JP 3-107328.
English Language Abstract of JP 6-113525.

* cited by examiner

ON
OFF

CLOSE
T0
T1
OPEN

ON
T2
OFF

ISA

T3
IQA

T4
P
IDF
Q

T5
IDS

T6
VCS
t0 t1 t2 t3 t4 t5 t6 t7

HYBRID DC ELECTROMAGNETIC CONTACTOR

BACKGROUND OF THE INVENTION

1. Field of the Invention

The present invention relates to a hybrid DC electromagnetic contactor, and in particular to a hybrid DC electromagnetic contactor capable of preventing arc occurrence in opening/closing of a hybrid-structured contactor and minimizing a leakage current by connecting a semiconductor switch to a mechanical contact switch in parallel.

2. Description of the Prior Art

In general, an electromagnetic contactor or an electromagnetic switch is used for connecting/cutting off power and load electrically.

The contactor connects/cuts off separately fixed-installed two electrodes through a moving electrode, power of an electromagnet is used in connecting, and power of a spring is used in cutting off (separating). Herein, when the switch is open and a current flows into the electrode, because arc is generated at a contact point due to energy stored in a stray inductance element of a line or a load or a power side, the contact point may be damaged.

Accordingly, a specific material and shape is required for the contact point of the contactor in order to stand the arc occurrence. And, in order to extinguish the arc instantly and safely, an arc extinguishing portion having a certain shape is required at the upper end of the contact point of the contactor.

In order to overcome the problem of the mechanical electromagnetic contactor, a SSR (solid-state relay) or a SSC (solid-state contactor) which replaces mechanical contact points of an AC electromagnetic switch with semiconductor switches has been presented and used. However, because lots of heat is generated by an applied current due to a voltage lowering at both ends of the semiconductor switch, an additional heat sink or cooling fan is required, and accordingly they have been used only for special purposes.

In addition, it is also possible to replace a DC electromagnetic contactor with a semiconductor switching device having a forced extinguishing function, however a mechanical DC electromagnetic contactor has been mainly used still.

FIG. 1 is a circuit diagram illustrating a construction of a conventional AC hybrid breaking switch.

As depicted in FIG. 1, AC power 1 is connected/separated to/from a load 7 through a mechanical main contact point 5. In a general AC electromagnetic switch, a sub contact point 4 is installed as a basic unit.

However, in the conventional AC hybrid switch, the main contact point 5 is connected in parallel to a triac 2 that functions as a two-way semiconductor switch, a resistance 3 is connected between a gate terminal G and an anode terminal A of the triac 2, and the sub contact point 4 of the switch is connected between the gate terminal G and a cathode terminal K of the triac 2.

The basic operation of the conventional AC hybrid breaking switch will be described through state changes (open or closed state) of the main contact point 5 of the switch.

In the breaking switch, when the main contact point 5 is open, the sub contact point 4 is closed, the gate G of the triac 2 is short-circuited from the cathode K, and the triac 2 maintains an off state. Herein, minute current (several tens~several hundreds mA) flows between the AC power 1 and the load 7 through the resistance 3.

In order to turn on the switch, when a voltage is applied to a coil 6, the main contact point 5 and the sub contact point 4 are moved, first the sub contact point 4 is opened before the main contact point 5 is closed, an operation signal is applied between the gate G and the cathode K of the triac 2, and accordingly several tens~several hundreds current flows into the gate terminal G of the triac 2.

Herein, because the triac 2 operates regardless of polarity of a gate current, it is turned on only when sufficient gate current flows into the triac 2, the AC power 1 and the load 7 are connected to the triac 2, and accordingly a current flowing on the load 7 flows into the triac 2.

When the main contact point 5 is closed after a certain time has passed, a chattering phenomenon occurs due to mechanical characteristics, a current flows on the gate G of the triac 2 in opening of the main contact point 5, and accordingly an arc is not generated at the mechanical contact point.

When the mechanical contact point is closed completely, both end voltages of the triac 2 reach almost to 0, a minimum voltage (in general, several volts) required for turning-on the triac 2 is not secured, and accordingly the triac 2 is turned off.

Afterward, when the voltage applied to the coil 6 is removed in order to turn off the switch, the moving electrode part of the main contact point 5 and the sub contact point 4 is moved, and the main contact point 5 is open first.

In opening of the main contact point 5, the current flows again on the gate G of the triac 2, the triac 2 is turned on, and the load current flows. Herein, because voltage lowering at both ends of the triac 2 is not greater than several volts, the generation of an arc is restrained.

After a certain time has passed, when the sub contact point 4 is closed, the gate G and the cathode K of the triac 2 are short circuited, the current flow on the gate G is 0, the polarity of the current flowing through the triac 2 is changed, and the load current continually flows through the triac 2 until the triac 2 is turned off.

However, the hybrid switch in FIG. 1 can be applied only when power is AC, if power is DC, because there is no method for extinguishing the triac 2 as a semiconductor switch device, a power semiconductor switching device having a forced extinguishing function such as an IGBT (insulated gate bipolar transistor), a MOS-FET (metal oxide semiconductor-field effect transistor) and a BJT (bipolar junction transistor) has to be used.

Hereinafter, a DC hybrid contactor using the IGBT will be described.

FIG. 2 is a circuit diagram illustrating a construction of the conventional DC hybrid contactor.

As depicted in FIG. 2, DC power 13 is connected/separated to/from a load 12 through a mechanical main contact point 14.

A semiconductor switch unit 11 is connected to the main contact point 14 in parallel, and the ends of a diode $D_f$ are connected to the load 12 and a—terminal of the DC power 13.

The semiconductor switch unit 11 includes an IGBT switch $Q_A$, a free wheeling diode $D_f$, a snubber diode $D_{S1}$, a snubber capacitor $C_{S1}$ and a snubber resistance $R_{S1}$.

The operation of the conventional DC hybrid contactor is similar to that of the AC hybrid contactor in FIG. 1.

When the open state of the main contact point 14 is changed to the closed state, an arc occurs due to a chattering phenomenon caused by mechanical characteristics. However, because a size of the arc is small, it is possible to turn off the IGBT switch $Q_A$ in the region, and accordingly only changing the closed state of the main contact point 14 into the open state will be described. Herein, in controlling the IGBT switch $Q_A$, if the load is a capacitor, a large in-rush current occurs when the switch is turned on. In that case, a current value flowing on the IGBT switch device is too big, and a production cost of the switch may rise.

First, in the opening state of the main contact point 14, because the IGBT switch QA is turned off, the DC power 13 and the load 12 are connected with each other through the snubber circuits $D_{S1}$, $C_{S1}$, $R_{S1}$. Accordingly, in order to turn on the contactor, a voltage is applied to a coil 19, herein, the IGBT switch $Q_A$ maintains the turn-off signal applied state.

In order to turn off the turned-on switch, the semiconductor switch $Q^A$ connected to the mechanical contactor in parallel is turned on first, the voltage applied to the coil 19 is removed, the current flowing through the main contact point 14 flows through the semiconductor switch QA, the voltage on both ends of the turned-on semiconductor switch $Q_A$ is 2V ~3V, and the main contact point 14 can be opened without any arc occurring. After a certain time has passed, when the operation signal applied to the gate G of the semiconductor switch $Q_A$ is removed, the current flowing through the load 12 flows through the diode $D_f$ and the resistance $R_{S1}$ and is stopped. Afterward, energy stored in a stray inductance Lw of the DC power side is absorbed into capacitor$C_{S1}$, the current flowing through the semiconductor switch $Q_A$ is stopped, and accordingly, the turn-off process of the contactor is finished.

In the conventional hybrid contactor, when both the semiconductor switch $Q_A$ and the main contact point are turned off, there is a problem. In more detail, in that state, the capacitor $C_{S1}$ maintains a charged state with a voltage almost equal to the voltage of the DC power 13 or the turned-off state unless there is no voltage change (in particular, voltage increase) of the DC power 13.

However, the capacitor $C_{S1}$ is actually charged due to the snubber discharge resistance $R_{S1}$ when the voltage of both ends of the capacitor $C_{S1}$ is smaller than the voltage of the DC power 13, the current flows from the DC power 13 to the load through the diode $D_{S1}$, the capacitor $C_{S1}$ and the resistance R s. Herein, when a resistance $R_{S1}$ value is small, a large current flows, and when a resistance ($R_{S1}$) value is large, a small current flows. If, the turn on/off processes are not performed frequently, it is possible to reduce a leakage current value by increasing a resistance ($R_{S1}$) value sufficiently.

However, because the snubber circuit is for restraining a spike voltage on both ends of the switch in turning-off of the semiconductor switch $Q_A$, the resistance $R_{S1}$ can not be increased that much. Accordingly, there is no way to prevent the leakage current phenomenon. In order to remove the leakage current, an additional switch for stopping discharge of the capacitor $C_{S1}$ can be installed.

However, although the additional switch is installed, when a size of the power voltage 13 is changed according to the passage of time, there is no way to prevent the leakage current. If the DC power is a storage battery, the storage battery is discharged continually due to the leakage current. If a voltage of the DC power 13 is not less than 100V, there is a risk of an electric shock accident at the load block due to the leakage current.

In addition, in the conventional art, if a polarity of the power connected to the switch is changed or the connection between the power side and the load side is changed, the operation of the switch may not be performed at all.

SUMMARY OF THE INVENTION

In order to solve the above-mentioned problems, it is an object of the present invention to use a snubber circuit for protecting a semiconductor switching device of the conventional DC hybrid contactor efficiently by reducing a size of a leakage current largely (1~2 uA level).

It is another object of the present invention to provide a DC hybrid contactor operating normally when a connection between a power block and a load block is changed or a current flowing direction is changed.

It is yet another object of the present invention to provide a hybrid DC electromagnetic contactor capable of being operated normally when polarity of power connected to a DC hybrid contactor is changed or AC power is applied.

In order to achieve the above-mentioned objects, a hybrid DC electromagnetic contactor in accordance with the present invention includes a power unit for supplying a certain power voltage; a main contact point of a breaking switch for providing a supply path of the power voltage by being switched in accordance with a voltage apply to an operational coil; a switch for providing a supply path of the power voltage according to a gate signal; a snubber circuit for charging voltage at both ends of the switch in turning off of the switch and discharging an electric current when the charged voltage is not less than a certain voltage; and a discharge current removing unit for removing the discharge current by providing a discharge current path to a load block in turning off of the switch.

Other objects, characteristics and advantages of the present invention will be described in detail with following embodiments.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiment of the present invention will be described in detail with reference to accompanying drawings.

Figure 3:
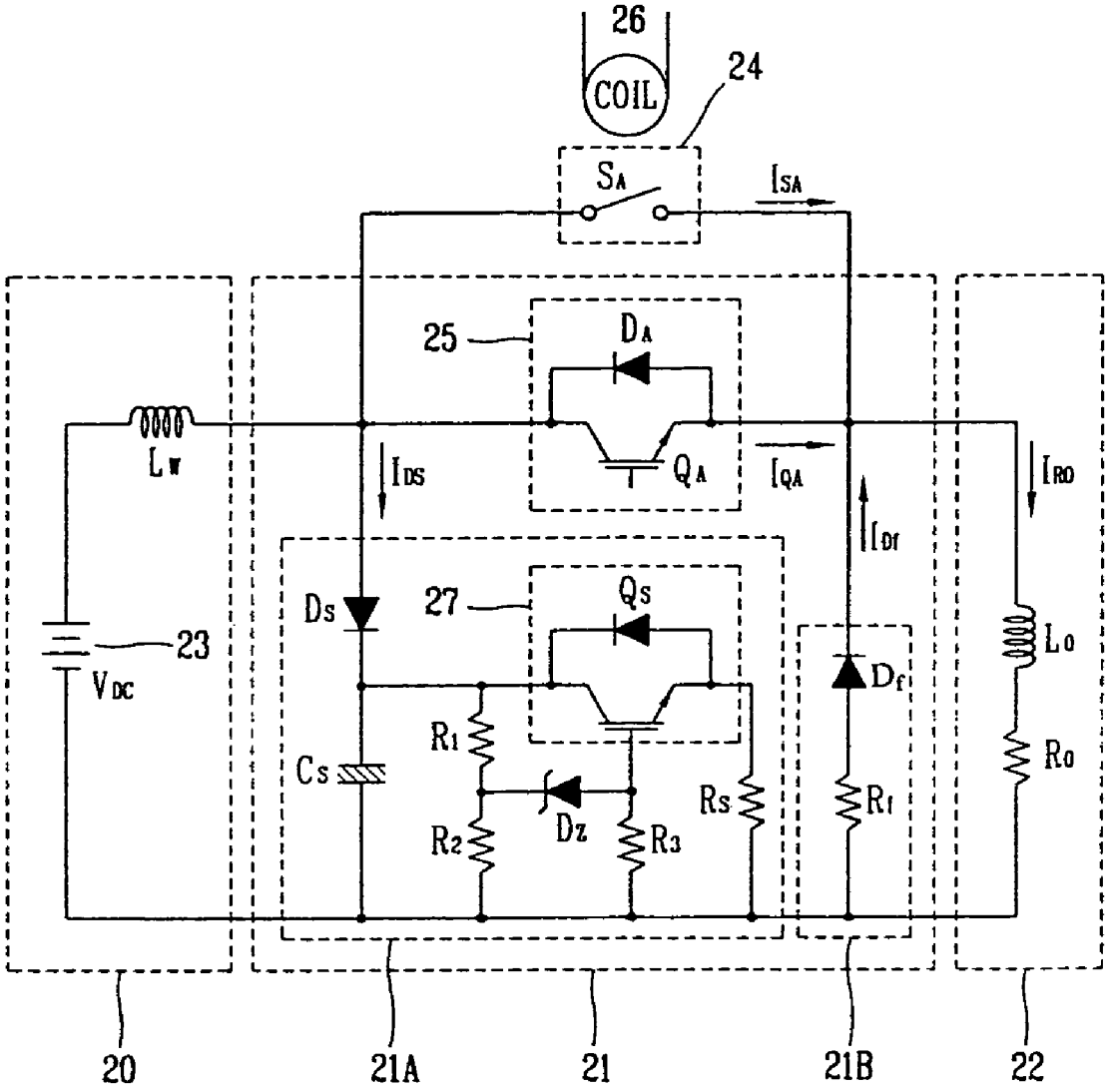
FIG. 3 is a circuit diagram illustrating a construction of a DC hybrid contactor in accordance with the present invention.

FIG. 3 is a circuit diagram illustrating a construction of a DC hybrid contactor in accordance with the present invention.

As depicted in FIG. 3, the DC hybrid contactor in accordance with the present invention includes a power unit 20 for supplying a certain power voltage; a main contact point 24 for providing a supply path of the power voltage by being switched according to the voltage apply to an operational coil 26; a first semiconductor switch 25 for providing a supply path of the power voltage according to a gate signal; a snubber circuit 21A for charging both ends voltage of the first semiconductor switch 25 in the turn-off of the first semiconductor switch 25, current being applied and discharged when the charged voltage is not less than a certain voltage; and a discharge current removing unit 21B for removing the discharge current by providing a discharge current path to a load block 22 when turning on the switch 25.

The operation of the DC hybrid contactor in accordance with the present invention will be described with reference to accompanying FIGS. 4A~4H showing operational waveforms thereof.

First, the main contact point 24 is connected between the load block 22 and the DC power 23, and the main contact point 24 is connected in parallel to the first main semiconductor switch 25. In addition, an over-voltage preventive snubber, comprising a first diode Ds and a capacitor Cs, are connected in series with one terminal of the power block 20 and a connect point of the first semiconductor switch 25, and a—terminal of the power unit 20. Circuits R1, R2, R3, Dz, Qs are connected to both ends of capacitor Cs in order to automatically discharge electricity through second semiconductor switch 27 and resistance Rs when a voltage of capacitor Cs exceeds a reference value. A discharge current removing unit 21B, comprising diode Df and resistance Rf is connected to both ends of the load terminal 22 in order to divert a load current IRo when the first semiconductor switch 25 is turned off.

Figures 4A, 4B, 4C, 4D, 4E, 4F, 4G, 4H:
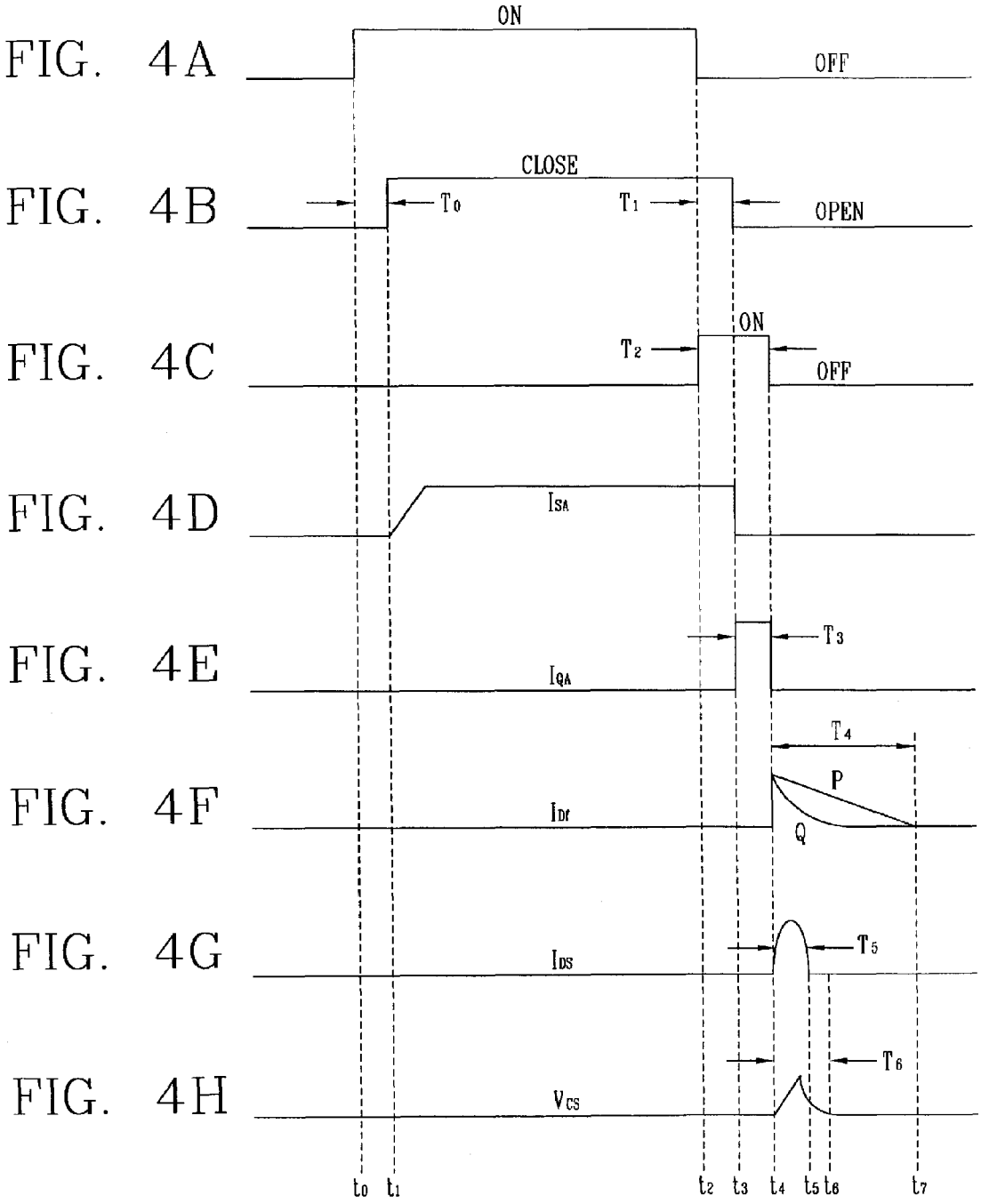
FIGS. 4A~4H are wave diagrams showing operations of the DC hybrid contactor in FIG. 3.

In the hybrid DC electromagnetic contactor in accordance with the present invention, at a time point of t=t0, when a voltage waveform shown in FIG. 4A is applied to the operational coil 26, after a certain time (t0) has passed, the main contact point 24 is connected. Herein, a turn-off signal is maintained at the first semiconductor switch 25 as depicted in FIG. 4C.

In a voltage waveform shown in FIG. 4D, the current flowing through the main contact point 24 at a time point of t=t1 increases with a certain slant and maintains a current value determined by a load resistance and a DC voltage.

At a time point of t=t2 shown in FIG. 4A, when the applied voltage of the operational coil 26 is removed, the main contact point 24 is open after a certain time (t1) has passed.

In addition, at a time point of t=t2 shown in FIG. 4C, a turn-on signal is applied to the first semiconductor switch 25.

At a time point of t=t3, when the main contact point 24 is actually open, the current flowing through the main contact point 24 is stopped as shown in FIG. 4D, and the load current flows on the first semiconductor switch 25 as shown in FIG. 4F. Herein, it is possible to control a length of a current flowing time (t3) through the first semiconductor switch 25 externally, and it is also possible to fix a length of a time (t3) so as to be same with ⅓~⅔ of a time (t1) taken by opening the main contact point 24.

At a time point of t=t4, when the first semiconductor switch 25 is turned off, the current flowing through the stray inductance Lw flows continually to the snubber circuit consisting of the capacitor Cs. Herein, the current flowing to the stray inductance Lw and the capacitor Cs is resonance current, the voltage at the both ends of the capacitor Cs increases from an early value (VCs) shown in FIG. 4H and reaches a voltage level determined by the resistance R1, R2 and a Zener diode Dz, it is discharged near to the early value VCs through the second semiconductor switch 27 and the resistance Rs.

If an end discharge value is set so as to be lower than a voltage of the DC power 23, because the capacitor Cs is automatically charged up to a size of the DC power 23 after the discharge is finished, it is possible to always maintain the same clamp voltage.

In the meantime, the current on the load terminal 22 flows through the resistance Rf and the diode Df as depicted in FIG. 4F, energy stored in the inductance Lo is consumed by the resistance Ro, Rf at a time point of t=t4, and finally the current is 0.

In a waveform P shown in FIG. 4F, because a resistance value is small, discharge is performed only through the diode Df and the resistance Rf. In a waveform Q shown in FIG. 4F, because a load resistance value is sufficiently big, energy stored in the inductance Lo is consumed.

Figure 1:
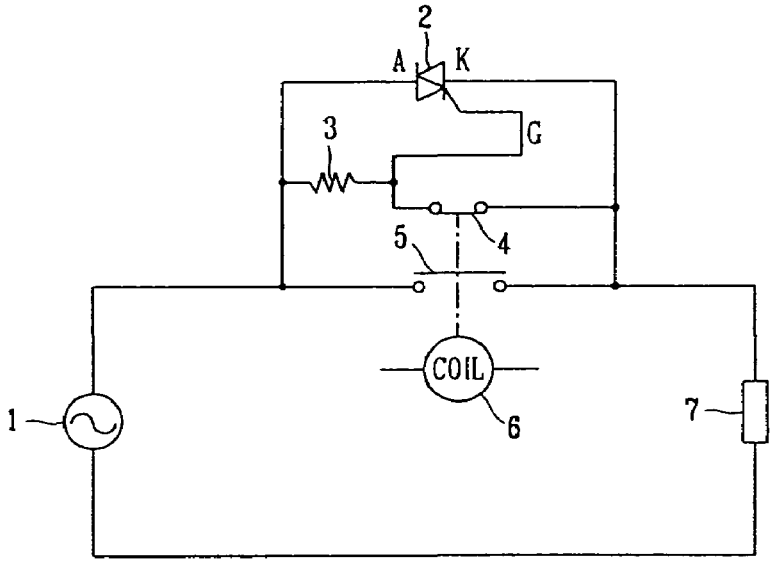
FIG. 1 CONVENTIONAL ART
FIG. 1 is a circuit diagram illustrating a construction of the conventional AC hybrid switch.
Figure 2:
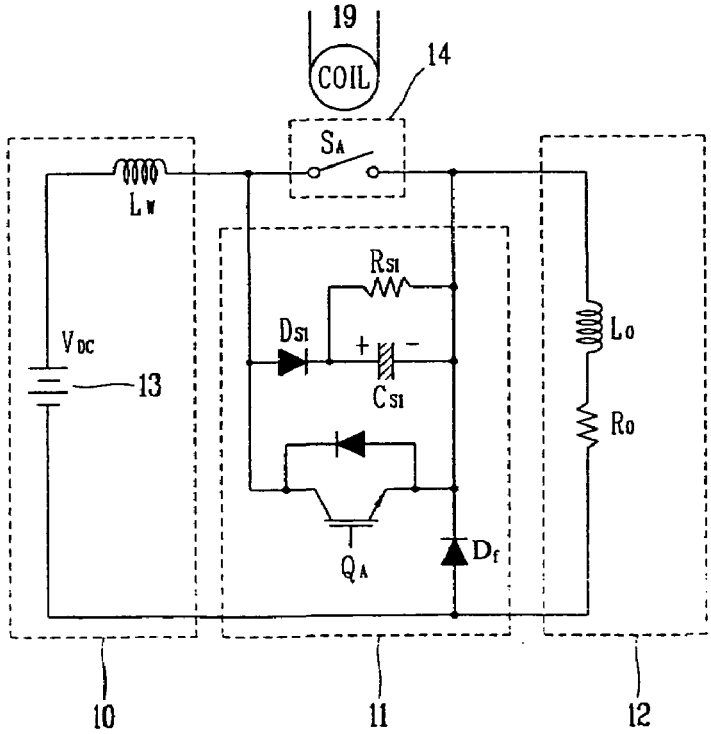
FIG. 2 CONVENTIONAL ART
FIG. 2 is a circuit diagram illustrating a construction of the conventional DC hybrid contactor.

As depicted in FIGS. 3 and 4A~4H, when the main contact point 24 and the first semiconductor switch 25 are turned off, because the first semiconductor switch 25 between the power block 20 and the load block 22 is turned off, the leakage current problem occurred through the snubber circuit shown in FIG. 2 can be prevented, although a voltage size of the DC power is varied, the problem can be prevented.

However, because the semiconductor switch does not have ideal insulating characteristics, a leakage current (in general, of several uA) flows through the semiconductor switching device. However, that amount of leakage current does not matter in actual applications.

Because each appropriate clamp circuit is used for the power block 20 and the load block 22 without using the snubber circuit at both ends of the semiconductor switch, those characteristics can be obtained. In addition, because energy accumulated in the snubber capacitor Cs for restraining over-voltage in turning-off of the power semiconductor is discharged automatically through the second semiconductor switch 27 and the resistance Rs, a certain voltage can be maintained.

The voltage at both ends of capacitor Cs is connected to Zener diode Dz through the voltage dividing resistances R1, R2, when the voltage of capacitor Cs reaches a voltage for flowing current to Zener diode Dz, energy charged in capacitor CS is automatically discharged through resistance Rs by turning on the second semiconductor switch 27.

In the meantime, in the present invention, the first semiconductor switch 25 connected in parallel with the main contact point 24 is not limited to an IGBT Other types of semiconductor devices, such as, for example, a BJT, a GTO, an IGCT, a RCT, etc. can be used. Because the DC contactor has only one main contact point, the present invention is described with that case. However, the present invention can also be applied to a case having several contact points.

Figure 5:
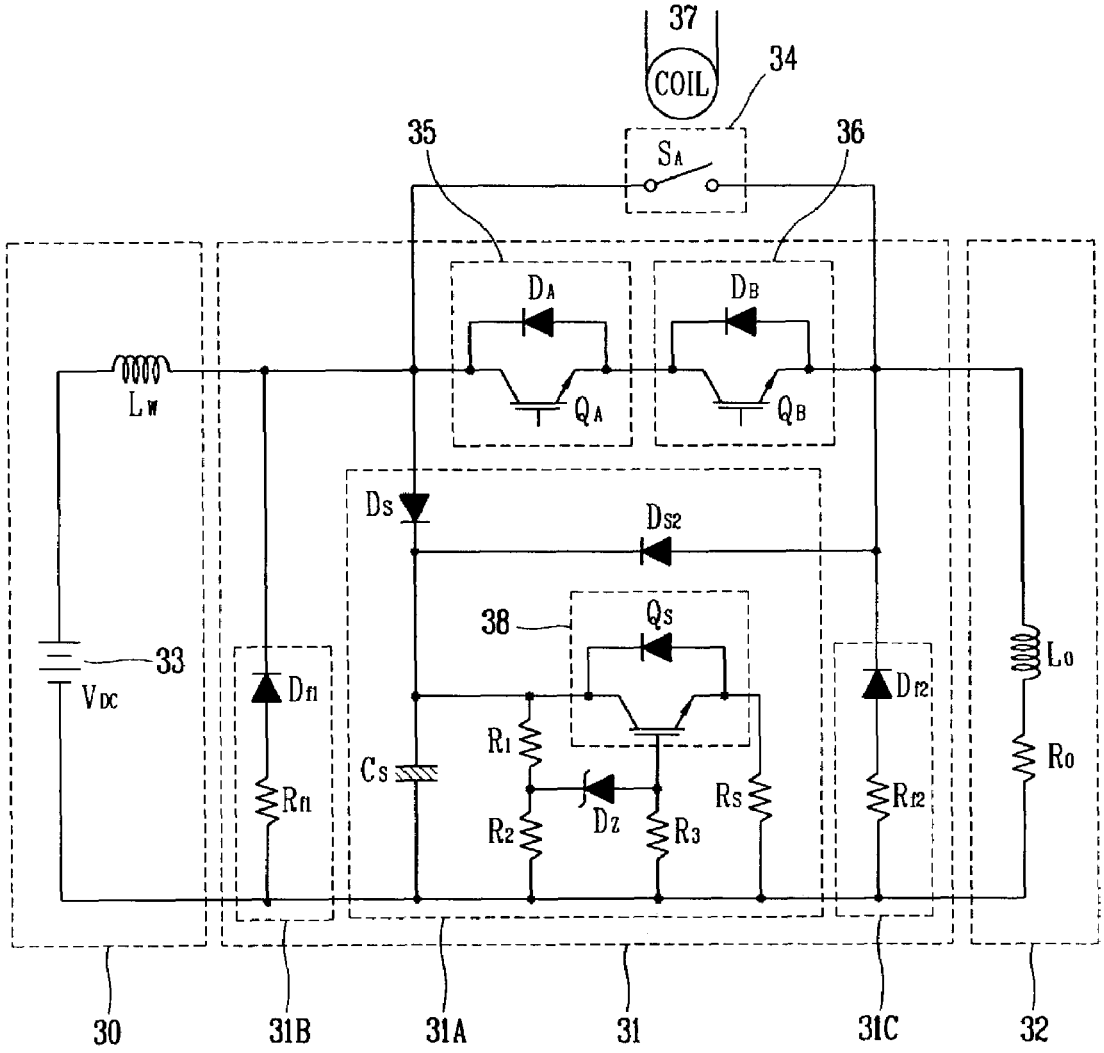
FIG. 5 is a circuit diagram illustrating an embodiment of a DC hybrid contactor in accordance with the present invention.

FIG. 5 is a circuit diagram illustrating another embodiment of a DC hybrid contactor in accordance with the present invention.

As depicted in FIG. 5, the DC hybrid contactor in accordance with another embodiment of the present invention includes a power unit 30 for supplying specific power voltage VDC; a breaking switch 34 for providing a supply path of the power voltage by being switched according to the voltage applied to an operational coil 37; two-way AC switches 35, 36 for providing a two-way supply path by a gate signal regardless of polarity of the power voltage; a snubber circuit 31A for maintaining a certain voltage by being automatically discharged when a voltage charged according to the application of the power voltage VDC is greater than a certain voltage in turning-off of the contactor 34 and the two-way AC switches 35, 36; and first and second discharge removing units 31B, 31C for removing a discharge current by providing a discharge current path of the load charging the voltage regardless of the polarity in turning-off of the switch.

Herein, the construction of the another embodiment different from the embodiment in FIG. 3 will be described.

First, in order to make the contactor in accordance with the another embodiment operate normally when input/output of another contactor is changed-connected or polarity of the load current is varied, a semiconductor switch connected in series with the main contact point 34 is replaced with the two-way AC switches 35, 36. The first and second discharge current removing units 31B, 31C are installed at both ends of the power unit 30 and the load block 32. The snubber circuit 31A, the power unit 30 and the load block 32 are respectively connected to capacitor Cs through diodes Ds1, Ds2.

In FIG. 5, if the DC power VDC is connected to the load block 32 and the load block 32 is connected to the power unit 30, the snubber circuit 31A consists of the diode Ds2 and the capacitor Cs, a free wheeling path of the load side is a path through the diode Df1 and the load Rf1, and a switch QB and a diode DA of the two-way AC switches 35, 36 perform a function of a power semiconductor.

Figure 6:
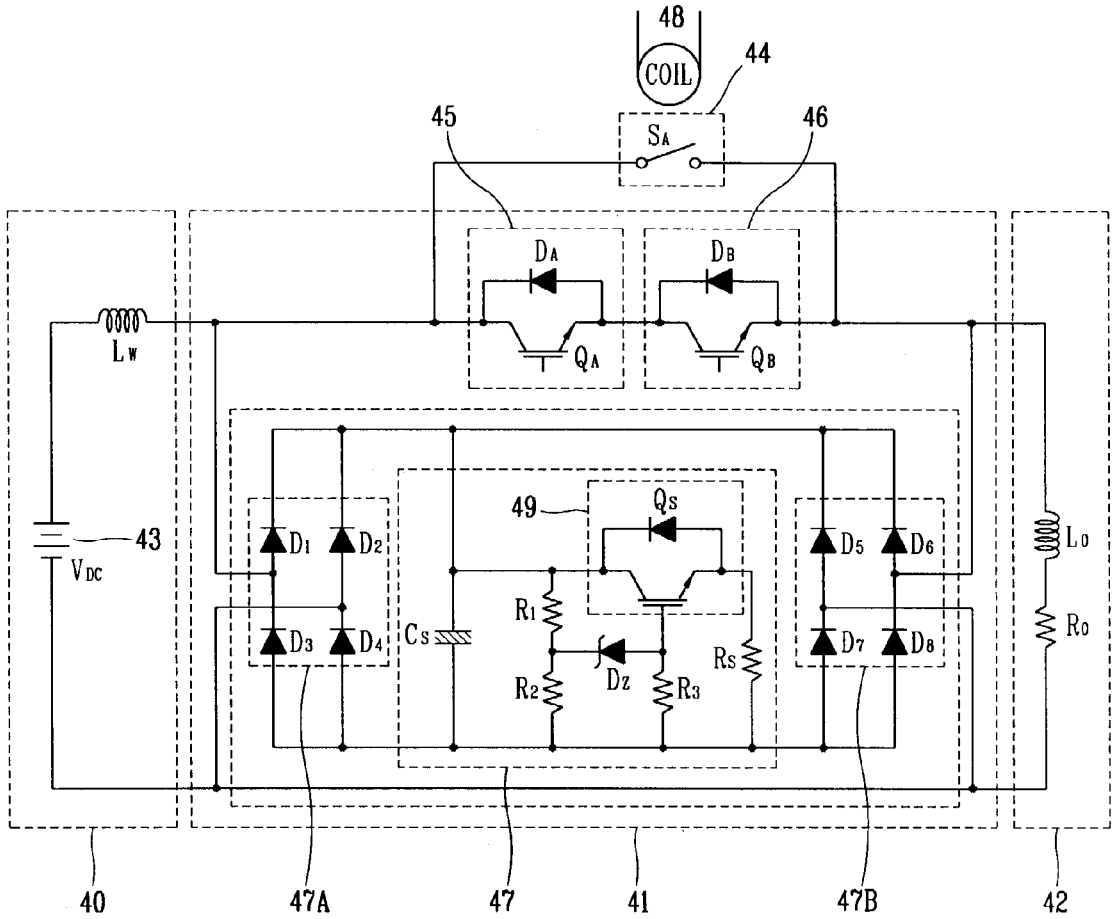
FIG. 6 is a circuit diagram illustrating another embodiment of a DC hybrid contactor in accordance with the present invention.

FIG. 6 is a circuit diagram illustrating yet another embodiment of a DC hybrid contactor in accordance with the present invention.

As depicted in FIG. 6, the circuit diagram illustrating yet another embodiment of a DC hybrid contactor in accordance with the present invention includes a power unit 40 for providing a certain AC or DC power voltage VDC; a breaking switch 44 for providing a supply path of the power voltage VDC by being switched according to the voltage applied to an operational coil 48; two-way AC switches 45, 46 for providing the supply path in two-ways by a gate signal regardless of polarity of the power unit 40; a snubber circuit and a discharge current removing unit 47 for providing a discharge current path of the load charged according to the power voltage apply of the power unit 40 and automatically maintaining a certain voltage by discharging an overvoltage (greater than a certain value) regardless of DC or AC in turning off of the breaking switch 44 and the two-way AC switches 45, 46.

Herein, a construction different from that of the embodiment in FIG. 3 will be described.

First, in order to make the contactor in accordance with the yet another embodiment operate normally when input/output of another contactor is changed-connected or polarity of the load current is varied, a semiconductor switch connected in series with main contact point 44 is replaced by two-way AC switches 45, 46. The snubber and the clamp circuit are replaced by bridge diodes 47A, 47B as depicted in FIG. 6.

Because the yet another embodiment of the present invention can perform functions similar to that of the conventional AC hybrid breaking switch and can cut off DC/AC flows, it has very wide operational characteristics.

First, clamp circuits D1, D2, D3, D4, Cs having a bridge-diode shape installed at both ends of the power unit 40 perform the snubber functions. In addition, the same-shaped clamp circuits installed at the load block 42 perform the same functions. As depicted in FIG. 6, in snubber circuit 47 of power unit 40, two diodes D1, D4 and capacitor Cs replace functions of the snubber diode Ds and capacitor Cs in FIG. 3, and two diodes D6, D7 of the load block 42 and capacitor Cs replace functions of the clamp circuits Df, Rf in FIG. 3.

Figure 7A:
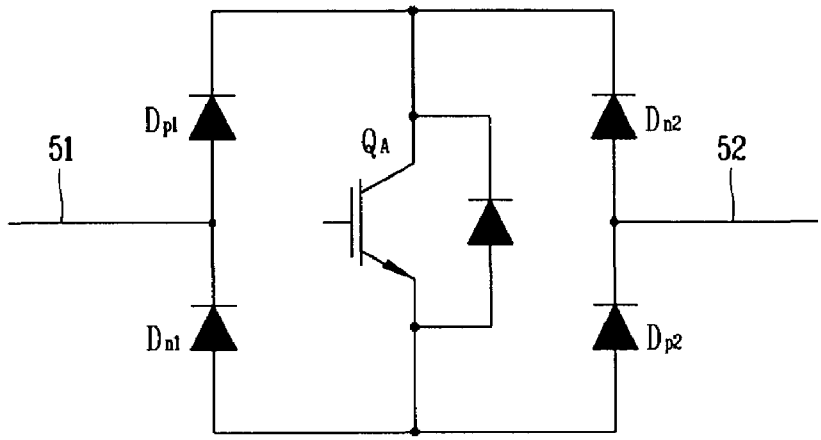
FIGS. 7A and 7B are circuit diagrams showing other embodiments of a two-way semiconductor switch for the DC hybrid contactors in FIGS. 5 and 6.
Figure 7B:
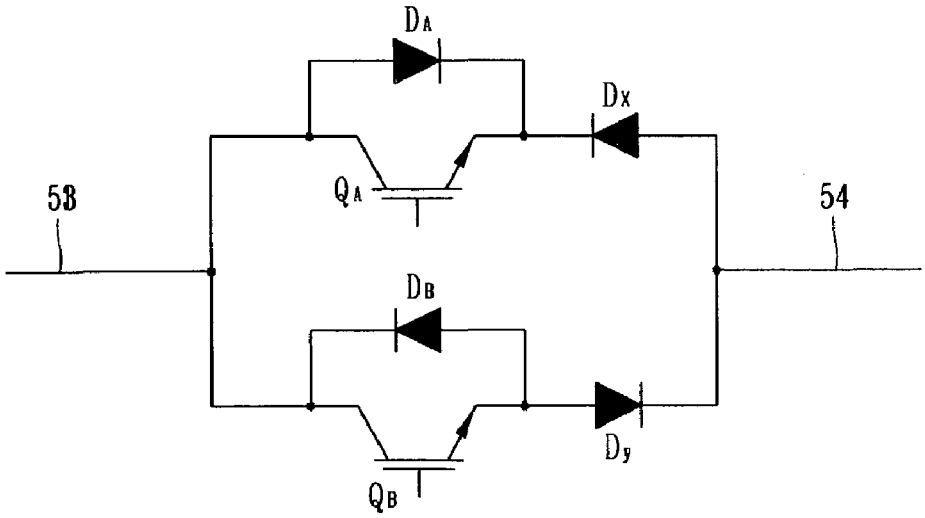

FIGS. 7A and 7B are circuit diagrams illustrating different constructions of the two-way semiconductor switches in FIGS. 5 and 6.

In FIG. 7A, an IGBT is used in a diode bridge configuration. In FIG. 7B, reverse direction cutoff diodes Dx, Dy are series connected to the IGBT. Two-way semiconductor switches in FIGS. 7A and 7B perform the same functions with those of the two-way semiconductor switches in FIGS. 5 and 6. For convenience, they have the same shape with that of the semiconductor switches in FIGS. 5 and 6.

Figure 8:
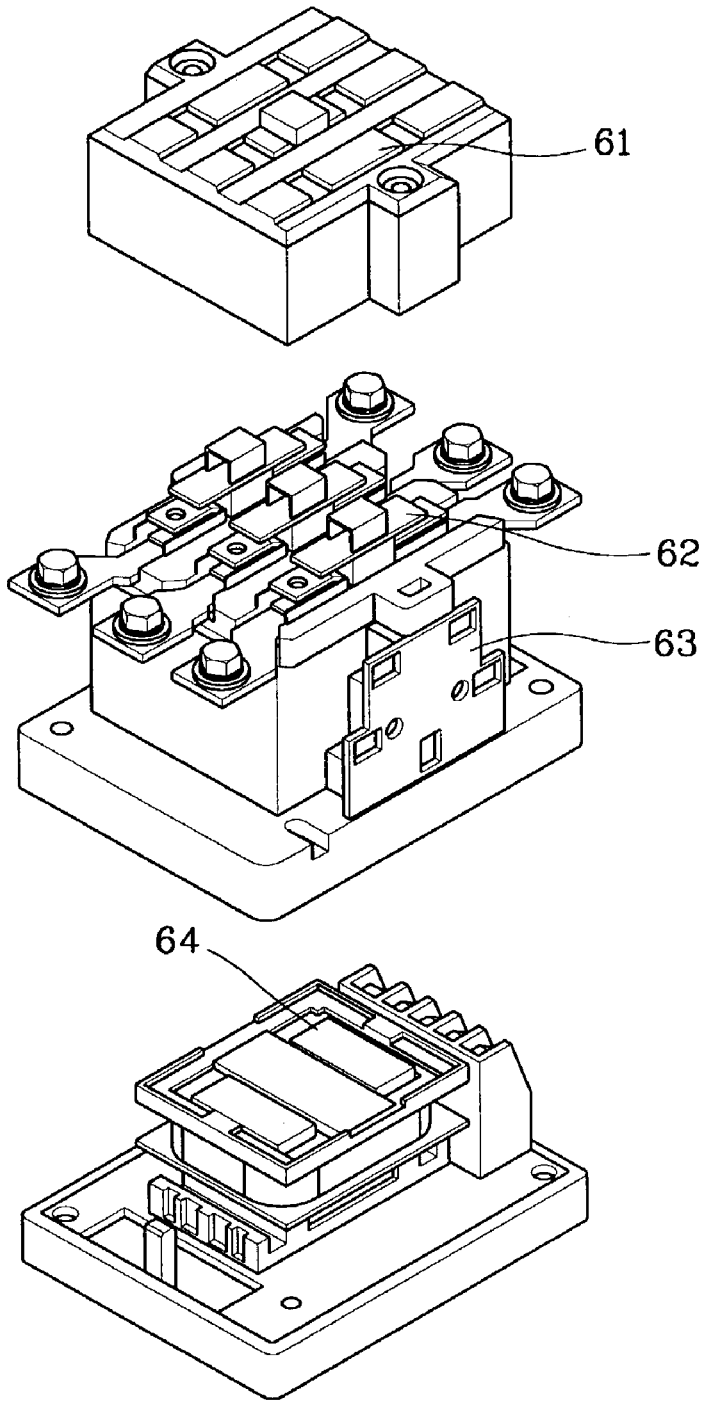
FIG. 8 is an exemplary view illustrating a semiconductor switch unit in accordance with the present invention installed on the conventional DC hybrid contactor.

FIG. 8 is an exemplary view illustrating a semiconductor switch unit in accordance with the present invention installed on the conventional DC hybrid contactor. By removing an arc extinguishing unit 61 from the conventional electromagnetic contactor and installing the semiconductor switch unit 21 in FIG. 3; the semiconductor switch unit 31 in FIG. 5 or the semiconductor switch unit 41 in FIG. 6; a main contact point 62; the sub contact point 63; and an operational coil 64 to the conventional AC electromagnetic contactor as module-shapes, it is possible to provide the DC contactor in accordance with the present invention having a height lower than that of the conventional electromagnetic contactor while maintaining the same current capacity.

As described above, in the DC hybrid contactor in accordance with the present invention, by minimizing a size of a leakage current in turning off of a main contact point and a semiconductor switch, it can be easily and efficiently used.

In addition, in the DC hybrid contactor in accordance with the present invention, although connection of a power block and a load block is changed or a current flow direction is changed or polarity of power connected thereto is changed or AC power is applied, it can be operated normally.

In addition, when the DC hybrid contactor in accordance with the present invention is applied to the conventional AC electromagnetic contactor, because an arc extinguishing unit of the AC electromagnetic contactor can be replaced into a semiconductor switch, it is possible to reduce a size of a DC hybrid switch sharply, and accordingly an AC electromagnetic contactor can be replaced into a DC electromagnetic switch.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A hybrid DC electromagnetic contactor, comprising:

a power unit that supplies an electrical voltage;

a main contact point of a breaking switch selectively switched to provide an electrical voltage supply path responsive to an operating voltage applied to an operational coil;

a switch operative to provide an alternative electrical voltage supply path responsive to a gate signal;

a snubber that charges a voltage applied to said switch when said switch is turned off, and being discharged by an electric current flow when the charged voltage is at least equal to a certain voltage; and a discharge current remover that removes a discharge current by providing a discharge path to a load block when said switch is turned off.

2. The contactor of claim 1, wherein said switch comprises a first semiconductor switch.

3. The contactor of claim 1, wherein said snubber diverges from a contact point at which a cathode of a diode and a capacitor are serially contacted, a first resistance and a second resistance being serially connected to said diverged snubber, a contact point of said first and second resistances being connected to an anode of a Zener diode, said first resistance being connected to a collector of a transistor, a fourth resistance being serially connected to an emitter of said transistor.

4. The contactor of claim 1, wherein a cathode of a diode and a first end of a resistance are connected to said discharge current remover.

5. A hybrid DC electromagnetic contactor, comprising:

a power unit that supplies an electrical voltage;

a main contact point of a breaking switch selectively switched to provide an electrical voltage supply path responsive to an operating voltage applied to an operational coil;

a switch operative to provide a two-way electrical voltage supply path responsive to a gate signal, regardless of a polarity of the electrical voltage;

a snubber that maintains a certain voltage by automatically applying and discharging a current when a charged voltage applied by turning off the contactor and said switch is at least equal to the certain voltage; and first and second discharge current removers that remove discharge current by providing a discharge current path for a charged load.

6. The contactor of claim 5, wherein said switch comprises a two-way AC switch.

7. The contactor of claim 5, wherein said switch comprises a first switching device and a second switching device.

8. The contactor of claim 7, wherein said first switching device comprises a first diode connected to a first transistor, and said second switching device comprises a second diode connected to a second transistor in the opposite direction of the first switching device.

9. The contactor of claim 7, wherein a first diode is connected in a forward direction with said first switching device, a second diode is connected in a forward direction with said second switching device, said first switching device is connected to said second switching device, and said first diode is serially connected to said second diode.

10. The contactor of claim 5, wherein a diode and a resistance are connected with each other, respectively, in said first and second discharge current removers.

11. A hybrid DC electromagnetic contactor, comprising:

a power unit that supplies an electrical voltage;

a main contact point of a breaking switch selectively switched to provide an electrical voltage supply path responsive to an operating voltage applied to an operational coil;

a switch operative to provide a two-way electrical voltage supply path responsive to a gate signal, regardless of a polarity of the electrical voltage; and a snubber and discharge current remover that includes a switching device that automatically performs a discharging operation to maintain a certain voltage.

12. The contactor of claim 11, wherein said switch comprises a two-way AC switch.

13. The contactor of claim 11, wherein said switch comprises a first switching device and a second switching device.

14. The contactor of claim 13, wherein said first switching device comprises a first diode connected to a first transistor in a backward-parallel arrangement, and said second switching device comprises a second diode connected to a second transistor in a backward-parallel arrangement in an opposite direction of said first switching device.

15. The contactor of claim 11, wherein said switch includes:

a first diode connected in a forward direction of said first switching device; and a second diode connected in a forward direction of said second switching device;

wherein said first switching device is connected to said second switching device, and said first diode is serially connected to said second diode.

16. The contactor of claim 11, wherein said snubber and discharge current remover includes:

a first bridge diode connected in parallel to a capacitor;

a first resistance and a second resistance connected in parallel to said capacitor, a first end of said first resistance being connected to a contact point of a diode connected in parallel to a transistor;

a Zener diode having an anode thereof connected to a base of said transistor, a cathode of said Zener diode being connected to an other end of said first resistance;

a third resistance having a first end connected to said base of said transistor and said anode of said Zener diode, a second end of said third resistance being connected to said second resistance in series; and a fourth resistance having a first end connected to an emitter of said transistor and a second end connected in series to a first end of a second bridge diode, a second end of said second bridge diode being connected to a contact point of said first resistance and said capacitor.

17. The contactor of claim 8, wherein a cathode of said first diode is connected to an emitter of said first transistor, an anode of said first diode is connected to a collector of said first transistor, and wherein an anode of said second diode is connected to an emitter of said second transistor, while a cathode of said second diode is connected to a collector of said second transistor.

* * * * *